US009995115B2

(12) United States Patent
Kasperski

(10) Patent No.: US 9,995,115 B2
(45) Date of Patent: Jun. 12, 2018

(54) BOOST ASSISTED FORCE BALANCING SETTING TOOL

(71) Applicant: HALLIBURTON ENERGY SERVICES, INC., Houston, TX (US)

(72) Inventor: Bryan Kasperski, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days. days.

(21) Appl. No.: 14/118,381

(22) PCT Filed: Jan. 10, 2013

(86) PCT No.: PCT/US2013/021008

§ 371 (c)(1),
(2) Date: Nov. 18, 2013

(87) PCT Pub. No.: WO2014/109748

PCT Pub. Date: Jul. 17, 2014

(65) Prior Publication Data

US 2015/0322747 A1 Nov. 12, 2015

(51) Int. Cl.

| | |
|---|---|
| ***E21B 41/00*** | (2006.01) |
| ***E21B 34/06*** | (2006.01) |
| *E21B 23/01* | (2006.01) |

(52) U.S. Cl.

CPC ..... *E21B 41/00* (2013.01); *E21B 34/063* (2013.01); *E21B 23/01* (2013.01)

(58) Field of Classification Search

CPC ..... E21B 23/065; E21B 23/04; E21B 41/00; E21B 34/063

See application file for complete search history.

(56) References Cited

U.S. PATENT DOCUMENTS

| | | | |
|---|---|---|---|
| 4,429,741 | A | 2/1984 | Hyland |
| 4,617,999 | A | 10/1986 | Beck |
| 5,316,087 | A | 5/1994 | Manke et al. |
| 5,447,202 | A | 9/1995 | Littleford |

(Continued)

OTHER PUBLICATIONS

International Search Report dated Sep. 13, 2013 for Application No. PCT/US2013/021008.

(Continued)

*Primary Examiner* — David J Bagnell
*Assistant Examiner* — Kristyn A Hall
(74) *Attorney, Agent, or Firm* — Chamberlain Hrdlicka

(57) ABSTRACT

A setting tool is provided for positioning in a subterranean wellbore. The tool carries a pre-charged, pressurized chamber, preferably filled with inert gas. A force-balanced piston assembly, with the piston chamber initially at atmospheric pressure, is in selective fluid communication with the pressurized chamber. A release mechanism, rupture disc, or valve is selectively operable to open the pressurized chamber and allow fluid flow to the piston chamber. The pressurized gas drives the piston which, in turn, drives a power rod for setting a downhole tool. Preferably a flow restrictor is incorporated in the gas flow path to meter the fluid and control the setting speed. In a preferred embodiment, the pressurized chamber is opened by rupturing a disc. A pyrotechnic device, which qualifies as a non-explosive device and is triggered by a low-powered battery, drives a piercing member into and through the rupture disc.

22 Claims, 3 Drawing Sheets

(56) References Cited

U.S. PATENT DOCUMENTS

| | | | | |
|---|---|---|---|---|
| 6,272,915 | B1 * | 8/2001 | Kostelnicek | E21B 47/042 166/250.03 |
| 6,966,370 | B2 | 11/2005 | Cook et al. | |
| 7,000,705 | B2 | 2/2006 | Buyers et al. | |
| 7,051,810 | B2 | 5/2006 | Clemens et al. | |
| 7,367,397 | B2 | 5/2008 | Clemens et al. | |
| 7,467,661 | B2 | 12/2008 | Gordon et al. | |
| 7,891,432 | B2 | 2/2011 | Assal | |
| 8,006,952 | B2 | 8/2011 | Wygnanski | |
| 8,235,103 | B2 | 8/2012 | Wright et al. | |
| 2003/0075339 | A1 | 4/2003 | Gano et al. | |
| 2005/0150661 | A1 * | 7/2005 | Kenison | E21B 33/1243 166/387 |
| 2006/0022013 | A1 | 2/2006 | Gaudron | |
| 2006/0076144 | A1 | 4/2006 | Shammai et al. | |
| 2008/0210439 | A1 * | 9/2008 | Angman | E21B 33/126 166/382 |
| 2009/0101341 | A1 * | 4/2009 | Willauer | E21B 34/066 166/250.15 |
| 2010/0307773 | A1 * | 12/2010 | Tinnen | E21B 23/06 166/387 |
| 2011/0073310 | A1 | 3/2011 | Clemens et al. | |
| 2011/0073328 | A1 | 3/2011 | Clemens et al. | |
| 2011/0073329 | A1 | 3/2011 | Clemens et al. | |
| 2011/0168403 | A1 | 7/2011 | Patel | |
| 2011/0174068 | A1 * | 7/2011 | Irani | E21B 49/081 73/152.23 |
| 2011/0174484 | A1 | 7/2011 | Wright et al. | |
| 2011/0174504 | A1 | 7/2011 | Wright et al. | |
| 2011/0259609 | A1 * | 10/2011 | Hesseis | E21B 23/04 166/382 |
| 2011/0265987 | A1 | 11/2011 | Wright et al. | |

OTHER PUBLICATIONS

Written Opinion dated Sep. 13, 2013 for Application No. PCT/US2013/021008.

* cited by examiner

BOOST ASSISTED FORCE BALANCING SETTING TOOL

CROSS REFERENCE TO RELATED APPLICATIONS

None.

FIELD

Methods and apparatus are presented for a force-balanced setting tool operable independent of wellbore hydrostatic pressure, and more particularly, to a force-balanced setting tool having a pre-charged, fluid chamber for force generation.

BACKGROUND

Without limiting the scope of the present inventions, their background is described with reference to setting tools, downhole force generators and downhole power units and improvements thereto. It is typical in hydrocarbon wells to "set" or actuate downhole tools, such as packers, bridge plugs, high-expansion gauge hangers, straddles, wellhead plugs, cement retainers, through-tubing plugs, etc. Additionally, some of these tools are later "unset" for retrieval. Setting tools are run-in, and in some cases retrieved, using various conveyance methods such as a wireline, slickline, or coiled tubing. The generic name for the running tool which provides the large setting forces required is a setting tool.

Several types of setting tool and downhole force generators are known in the art, including those operated mechanically, electrically, chemically, explosively, hydraulically, electro-mechanically, etc. One type of DFG uses electro-mechanical power, where the DFG converts electrical power, typically provided by a battery unit, into mechanical movement, typically rotary or longitudinal movement of a shaft or power rod. One such setting tool is the DPU (trade name) Downhole Power Unit available from Halliburton Energy Services, Inc.

Additionally, industry standard setting tools, for example, the Baker E4 or Baker 20 setting tool and the Halliburton "Shorty," operate utilizing a force generated by rapidly burning chemicals, typically in a pyrotechnic charge, to create a high-pressure gas. Such explosive tools are referred to generically as "pyrotechnic" setting tools or force generators. These tools create and contain high pressure gas by igniting a pyrotechnic charge in a closed chamber. The pyrotechnic charge is initiated by electrical current supplied from the surface down an electric cable or from batteries carried downhole with the setting tool and used in conjunction with associated pre-programmed timers, electronics package, etc. The chamber containing the high pressure gas features a floating hydraulic piston with an oil filled chamber below. The hydraulic oil is pressured by the expanding gas, providing hydraulic power which performs the setting task. Disadvantages to such pyrotechnic setting tools include the necessity of transporting a gas-pressured container to the surface after use and releasing the pressure in a controlled and safe manner Such venting is hazardous and conducted under strictly controlled conditions. Further, extensive and costly regulations require special shipping and handling of the pyrotechnic tools by trained personnel, storage on licensed premises, third party notification when shipping, inspections by official personnel, and routine inspections.

Hydrostatic setting tools convert ambient hydrostatic pressure in a wellbore into hydraulic force to set the downhole tool. The setting tool is equipped with a series of pistons which each have atmospheric pressure on both sides of the piston. The piston series provides motive force. When a valve is opened (by signal or timer) well pressure acts on one side of the pistons causing a pressure imbalance. Bottom hole pressures are typically too small produce sufficient hydraulic power to set a tool, so the force-multiplier pistons generate the pressures needed. Typically, a 1 to 5 multiplier may be required. Such tools can be unwieldy due to the required length necessary for the series of pistons and performance is only marginal in certain circumstances.

Hydraulic setting tools operate based on operator-increased pressure in the tool string. Typically a mandrel is connected to a work string, a stationary piston connected to the mandrel and dividing an interior chamber into two hydraulic chambers, and a hydraulic cylinder is slidingly mounted on the mandrel. An inlet port allows fluid into the bottom hydraulic chamber, which in turn urges the cylinder away from the stationary piston. As the cylinder moves downward, fluid flows out of the top hydraulic chamber via an outlet port. The movement of the cylinder is used to actuate or set other tools. Hydraulic setting tools can be damaged by hostile environments. Extreme hydrostatic pressure and imbalances between interior and exterior pressures can impair subsequent operation by deforming tool parts.

Disclosure relating to downhole force generators, their operation and construction can be found in the following, which are each incorporated herein for all purposes: U.S. Pat. No. 7,051,810 to Clemens, filed Sep. 15, 2003; U.S. Pat. No. 7,367,397 to Clemens, filed Jan. 5, 2006; U.S. Pat. No. 7,467,661 to Gordon, filed Jun. 1, 2006; U.S. Pat. No. 7,000,705 to Baker, filed Sep. 3, 2003; U.S. Pat. No. 7,891,432 to Assal, filed Feb. 26, 2008; U.S. Patent Application Publication No. 2011/0168403 to Patel, filed Jan. 7, 2011; U.S. Patent Application Publication Nos. 2011/0073328 to Clemens, filed Sep. 23, 2010; 2011/0073329 to Clemens, filed Sep. 23, 2010; 2011/0073310 to Clemens, filed Sep. 23, 2010; and International Application No. PCT/US2012/51545, to Halliburton Energy Services, Inc., filed Aug. 20, 2012.

It is an object of the invention then, to provide a pressure-actuated setting tool with a self-contained motive force generator. It is a further object of this invention to provide a setting tool which is not subject to the regulations and restrictions of typical pyrotechnic setting tools. It is a further object of the invention to provide a setting tool with regulated setting speeds. It is a further object of this invention to provide a setting tool which is force-balanced. It is a further object of this invention to provide a setting tool of reasonable length. Other objects and benefits will be apparent to those of skill in the art.

SUMMARY

In aspects, the present disclosure provides methods and apparatus for setting a tool positioned in a subterranean wellbore. In one embodiment, the tool carries a pre-charged pressurized chamber, preferably with an inert gas. A force-balanced piston assembly, with the piston chamber initially at atmospheric pressure, is in selective fluid communication with the pressurized chamber. A release mechanism is selectively operable to open the pressurized chamber and allow fluid flow to the piston chamber. The pressurized gas drives the piston which, in turn, drives a power rod for setting a downhole tool. Preferably a flow restrictor is incorporated in the gas flow path to meter the fluid and control the setting speed. In a preferred embodiment, the pressurized chamber is opened by rupturing a disc or other removable barrier. A pyrotechnic device, which preferably qualifies as a non-explosive device for purposes of transport, etc., is used to drive a piercing member into and through the rupture disc. The pyrotechnic initiator is triggered by a low-powered charge, preferably from a battery carried on the setting tool. A check valve or the like can be used in some embodiments.

DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Figure 1:
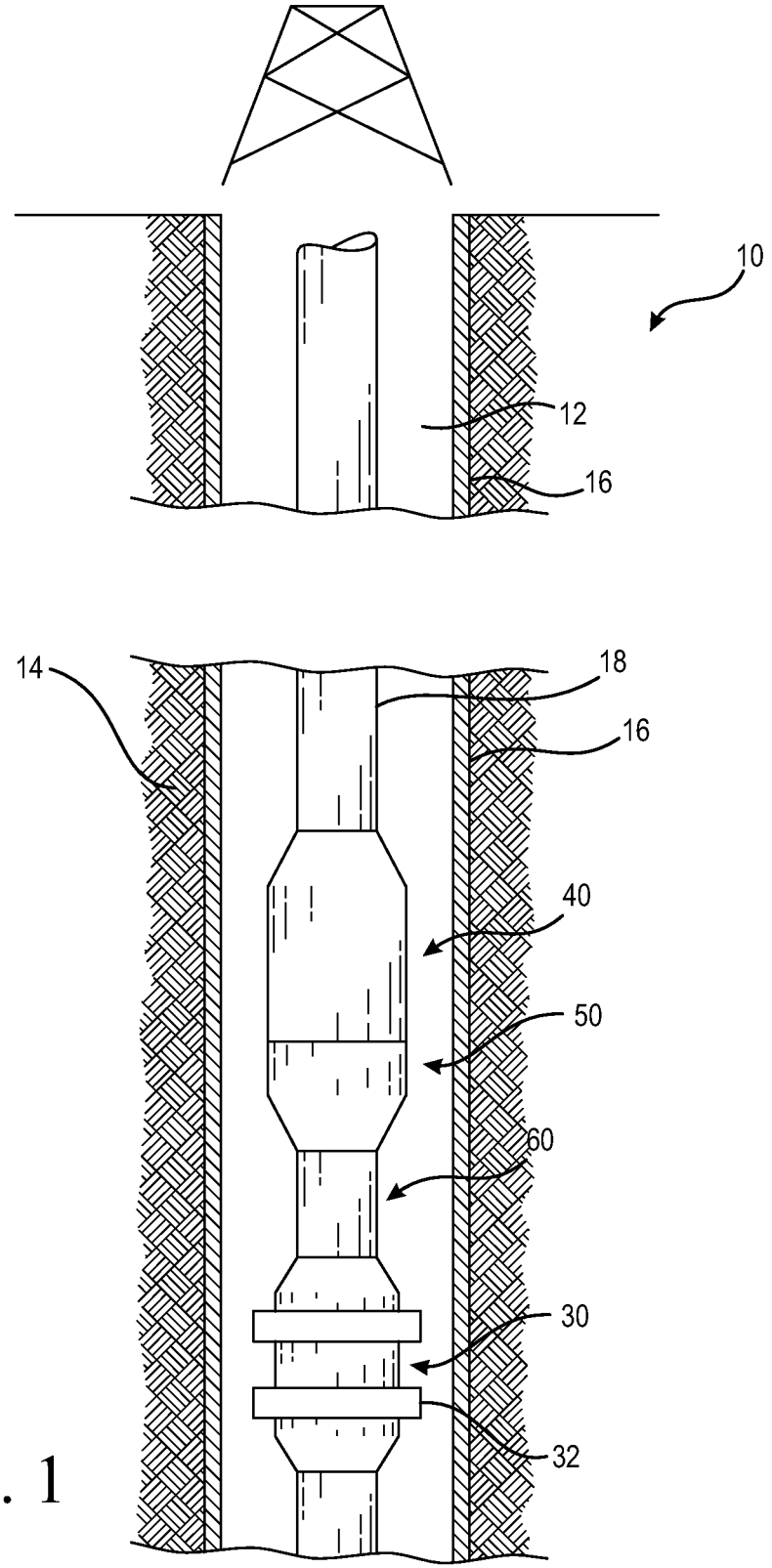
FIG. 1 is a schematic view of a well system including an embodiment of the invention positioned in a subterranean wellbore.

FIG. 1 is a schematic view of a well system including an embodiment of the invention positioned in a subterranean wellbore. A well system 10 is depicted having a wellbore 12 extending through a subterranean formation 14, shown having casing 16. The invention can be used in cased or uncased wells, vertical, deviated or horizontal wells, and for on-shore or off-shore drilling. A tubing string 18 is shown having a plurality of tubing sections, a settable downhole tool 30, a downhole force generator (DFG) assembly 40, and a force multiplier assembly 50. A mechanical linkage assembly 60 between the DFG and the downhole tool is provided for transferring the power generated by the DFG into longitudinal or rotary movement, such via a shaft, piston, sleeve, etc. The DFG assembly preferably includes a processor to operate the tool, measure environmental and tool parameters, etc. The settable downhole tools operable by DFG units are not described herein and are well known in the art. For ease of discussion, and by way of example, settable downhole tools such as settable tool 30, shown as a packer, may be utilized in sealing and anchoring the tubing string at a downhole location. The packer has sealing elements 32 which may be set, along with slips, anchors, etc., as is known in the art.

Figure 2:
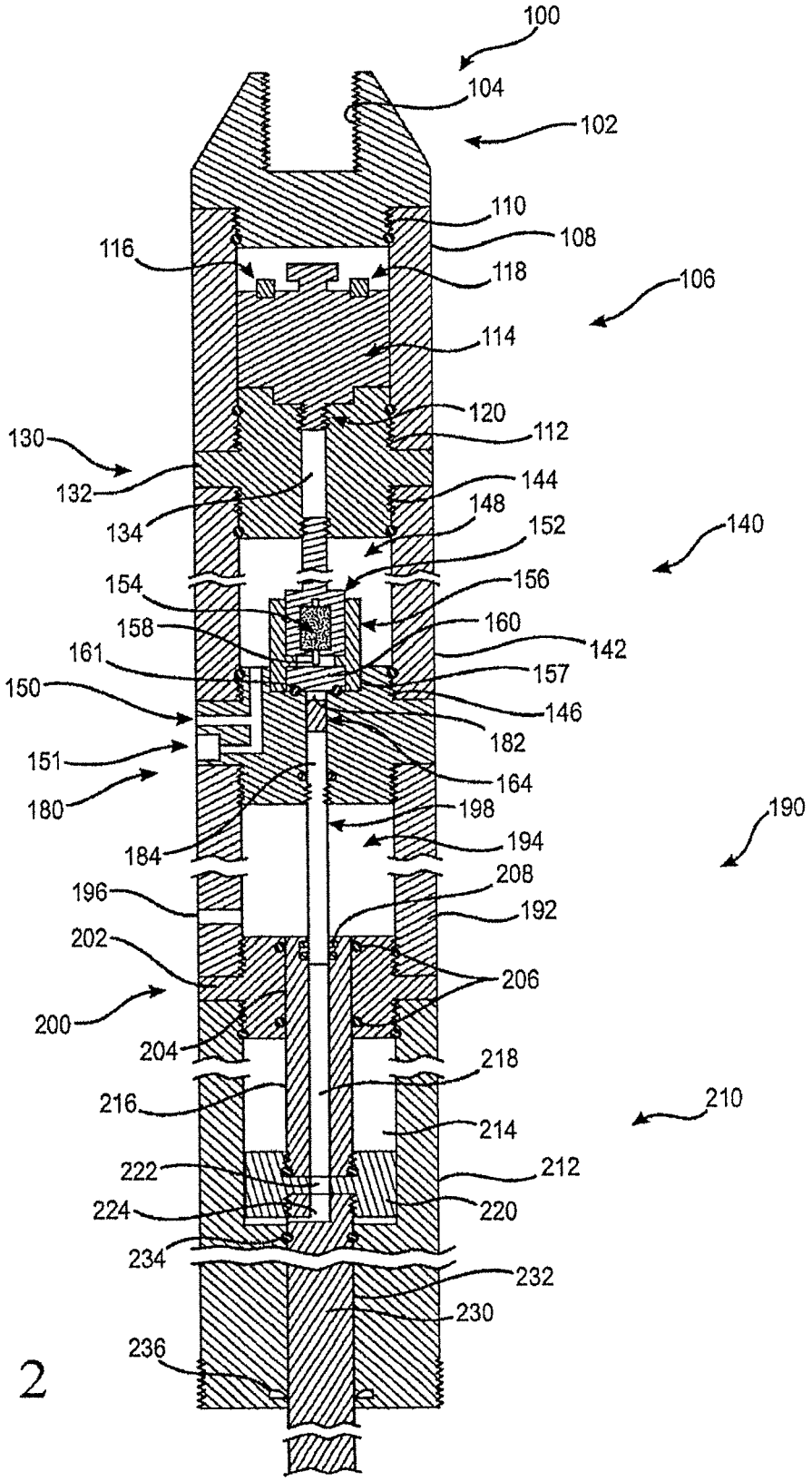
FIG. 2 is a cross-sectional schematic view of an exemplary booster-based, force-balanced setting tool assembly 100 according to an aspect of the invention and in an initial position.
Figure 3:
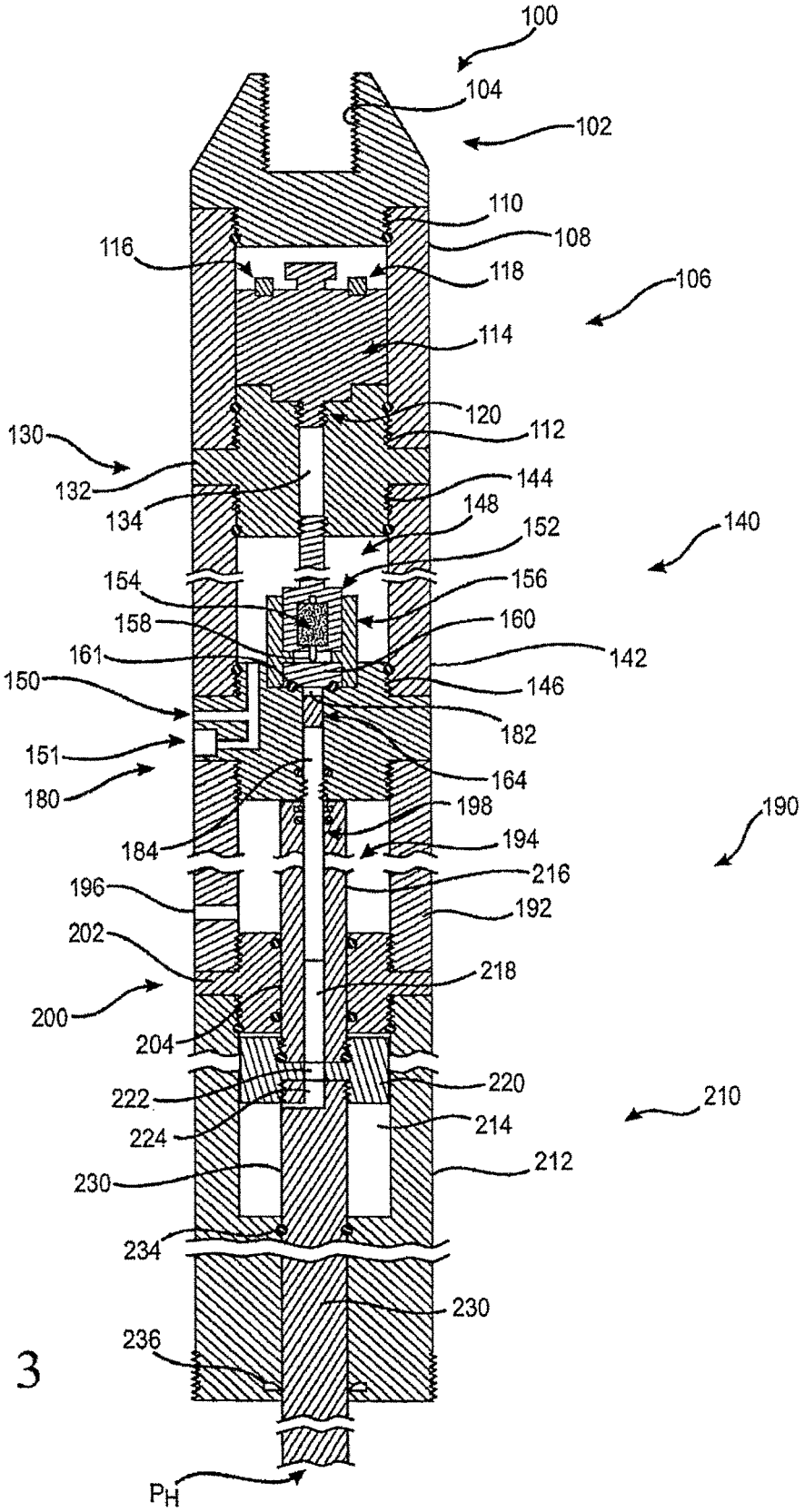
FIG. 3 is a cross-sectional schematic view of an exemplary booster-based, force-balanced setting tool assembly according to FIG. 2 in an actuated or set position.

FIG. 2 is a cross-sectional schematic view of an exemplary booster-based, force-balanced setting tool assembly 100 according to an aspect of the invention. FIG. 3 is a cross-sectional schematic view of an exemplary booster-based, force-balanced setting tool assembly according to FIG. 2 in an actuated or set position. The Figures are discussed in conjunction. The setting assembly 100 can be used in conjunction with any settable tool or tool requiring a mechanical movement in a downhole environment. The movement most frequently used is a linear axial stroke, in either direction. The embodiment of the setting assembly shown provides an axially upward movement of a selected stroke length. As those of skill in the art will recognize, other embodiments can provide a downward setting stroke. Additionally, the setting assembly can be used to provide other types of mechanical motion, such as rotational, etc., with appropriate mechanical parts to translate motion, as will be recognized by those of skill in the art. The embodiment is discussed in terms of a setting tool for use in linear actuation of a downhole tool, however, it is understood that the invention disclosed herein can be used in other types of tool assemblies and for providing non-axial motive force.

The setting tool assembly 100 has an upper connector subassembly 102, shown configured for connection at threads 104 to a sucker rod (not shown) or similar. It is understood that the upper connector can be selected for connection to a tool string, wireline, coiled tubing, etc. The upper connector 102 has lower threads at 110 which mate with the housing 108 of the control assembly.

The control assembly 106 has a housing 108, preferably a tubular body, connected to the upper connector sub 102 at threads 110 and connected at threads 112 to connector subassembly 130. The control assembly 106 houses an electronic control module 114 having, in a preferred embodiment, a power source, such as batteries, an electric-powered timer or timing device, and indicators 118 for start-up and timer set values. The indicators can be LED or other indicators as known in the art. The timer and battery packs are not discussed in detail and are known in the art. An electrical connector 116 is preferably provided for e-line start. It is also possible to provide electrical power via power line from the surface for signaling initiation, powering the initiator or actuator, etc. Further disclosure regarding timers, batteries, etc., can be found in the references incorporated herein. A hermetic connector 120 is positioned between the control module 114 and connector sub 130 to provide a hermetically sealed section for housing the control module.

A connector subassembly 130 has a connector body 132 with a bore 134 defined therein and extending axially therethrough. The bore 134 houses communication lines, such as electrical wiring, necessary for transmitting a signal from the control module to the actuator 154. The connector sub attaches to housing 108 at its upper end and to housing 142 at its lower end.

A booster assembly 140 has a housing 142 attached at threads 144 to the connector sub 130 and at threads 146 to connector sub 180. The booster assembly 140 defines a booster chamber 148 which is pre-charged with a pressurized fluid, preferably an inert gas to an actuation pressure. A charge port 151 and charging valve 150 are provided, with appropriate fluid passageways to the chamber, for supplying the pressurized gas to the chamber. In the embodiment shown, the charging valve and port are positioned in connector sub 180, although they can be positioned in connector sub 130 or as part of the booster assembly 140.

Positioned in the booster assembly is an initiator 154, actuator retainer 152, rupture disc 160, and pin actuator 158. The initiator 154 is electrically connected via wire extending from the actuator retainer 152, through a conduit or similar which is in threaded connection to the passageway 134 of connector assembly 130, and the control electronic control module 114. The initiator is triggered by a small electrical charge. The actuator retainer 152 houses the initiator 154. The rupture disc retainer and actuator guide 156 is mounted to the tool assembly, for example, to the connector assembly 180, as shown, via threaded connection or similar. Alternately, the retainer can be mounted to the housing, etc. The initiator 154 is positioned adjacent or proximate a rupture disc 160 that initially blocks fluid flow from the pressurized chamber.

Small, pyrotechnic initiators 154 are available from commercial vendors known in the art, such as SDI, Inc. The pyrotechnic initiator utilizes a small amount of pyrotechnic material, triggerable by a low electrical charge, to drive a thruster pin 158 longitudinally into and rupturing the rupture disc. The pin is preferably hollow with a relief port on the stem such that if the disc fails to rupture after the pin has pushed through the disc, a fluid path is available through the pin. Note that the pyrotechnic initiator does not provide the motive force for movement of the setting rod. The tool assembly is not a pyrotechnic setting tool. The initiator only provides motive force to move the pin actuator to rupture a rupture disc. The motive force for setting the tool is provided by the release of pressurized gas in the booster chamber. Because such a low amount of force is required of the initiator, and such a small amount of chemical or pyrotechnic required to provide the force, the preferred pyrotechnic initiator is classified by DOT and BATF as a non-explosive for purposes of transportation and shipping.

In addition to the preferred pyrotechnic initiator, other initiators can be used, preferably low-powered and classified as non-explosive. For example, such initiators include electrical, chemical, thermal, and other initiators. The initiators can open the pressurized chamber by opening, melting, dissolving, burning, etc., a fluid barrier. Further, the initiator can be used to power or actuate a variety of available actuators, such as a thruster pin, a check-valve, other valves, etc., to open the pressurized chamber to fluid flow.

Power to trigger the initiator is provided from the battery pack or power source in the electronic control module 114 of the control assembly 106. Since the preferred initiator is small and requires low power to initiate, it is ideal for low-powered battery activation. With a small power requirement, the timer can be small and low power and included within the timer module (e.g., a single CFX battery from Contour Energy; rated to 160 C and higher). The timer module can be small and used for the various tools for the different setting tools. The small timer module can thermally insulated, for example, for use in higher temperature operations within the larger housings of the bigger setting tools. The timer module is preferably switch-selectable and can include an electrical start port for either e-line or a pressure/temperature switch. Additional features could be added to the timer (pressure, temperature, motion, etc.), however, this would result in a larger electronics and battery assembly.

The rupture disc 160 can be selected from those known in the art and alternative discs and rupture assemblies will be apparent to those of skill in the art. The disc can be made of ceramic, metal, plastic, etc. The disc can be ruptured, punctured, dissolved, melted, etc., depending on the selected initiator and actuator. The preferred assembly utilizes a rupture disc which is physically punctured or broken by the extendable pin of the initiator. The rupture disc 160 initially blocks fluid flow from pressurized chamber 148 into passageway 184 of connector assembly 180. In a preferred embodiment, the rupture disc is mounted to the housing, connector assembly or retainer 156. The disc assembly is positioned in a bore 157 designed for that purpose in the connector assembly 180. Seals 161 are provided as necessary to facilitate assembly and fluid isolation. The retainer 156 provides and maintains positioning of the disc. Upon rupture, fluid communication is provided between the pressurized chamber 148 and the passageway 184 through connector assembly 180.

The initiator assembly, in a preferred embodiment, is a thruster assembly for rupturing discs. Actuator assemblies are commercially used by Halliburton Energy Services, Inc., and disclosure regarding their structure and use can be found in the following, which are each hereby incorporated by reference for all purposes: U.S. Pat. No. 8,235103, to Wright, issued Aug. 7, 2012; U.S. Patent Application Publication No. 2011/0174504, to Wright, filed Jan. 15, 2010; and U.S. Patent Application Publication No. 2011/0174484, to Wright, filed Dec. 11, 2010; U.S. Patent Publication No. 2011/0265987, to Wright, filed Apr. 28, 2010; and U.S. Patent Application Serial No. PCT/US12/53448 filed Aug. 31, 2012, to Fripp, et al. Additional actuator assemblies are known in the art and will be understood by persons of skill in the art. Additional actuator assemblies are known in the art and will be understood by persons of skill in the art. Key components are the rupture disc, an electrical power source, and an electrically-initiated method of breaching the barrier disc. In the preferred embodiment, the electrical power source is a battery, and a thruster assembly is used to puncture the disc.

Connector assembly 180 is attached to a vent chamber assembly 190, preferably by threaded connection to a vent chamber housing 192. The vent chamber 194 defined within the vent chamber assembly contains fluid at hydrostatic pressure as it is open to fluid flow between the chamber and the exterior of the tool (the wellbore). One or more ports 196 provide fluid communication between chamber and exterior. A thick-walled tube 198 extends from the passageway 184 to a force-balance piston rod 216, providing communication of the released pressurized gas from the pressurized chamber 148 to the piston passageway 218. As piston rod 216 moves upward into the vent chamber, pressure is equalized in the vent chamber 194 as fluid flows out of the chamber through ports 196. Note that the setting section is force balanced by hydrostatic pressure acting on the power rod 230 from below, so the setting action is independent of hydrostatic pressure.

A flow restrictor 164 is preferably positioned across the passageway 182 of the connector assembly 180. The speed of setting is controlled by the flow restrictor. The flow restrictor can be positioned elsewhere along the flow path from the pressurized chamber to the piston head. Flow restrictors and use thereof to control setting speed is known in the art. The flow restrictor can be a flow nozzle, orifice, plate, inflow control device, autonomonous inflow control device, tortuous path etc, as known in the art.

A connector assembly 200 provides flow connection between the vent chamber assembly 190 and the force-balance piston assembly 210. The connector assembly body 202 is threadedly attached to the vent chamber housing 192 and to a piston housing 212. An axial passageway 204 is defined through the connector body, the piston rod 216 axially slidable therein. Seals 206 are provided for sealing engagement between passageway wall and piston. Further, rod-wipes 208, or similar, are mounted to wipe the exterior surface of the piston as it moves through the passageway 204.

A piston assembly 210 is attached to the connector assembly 200 at housing 212. The housing defines a piston chamber 214 which is divided into two spaces by piston head 220. The chamber 214 is preferably at atmospheric pressure initially. Piston rod 216 defines an axial passageway 218 therein providing fluid communication from the tube 198 to a passageway 222 through the piston head 220. The piston rod 216 is mounted to the piston head 220. A power rod 230 is attached to the lower end of the piston head 220. Appropriate porting 224 provides fluid communication from the passageway 218 of the piston rod to the chamber 214 below the piston head 220. When pressurized gas is released from pressurized chamber 148, the gas flows through the various passageways and tubes, through passageway 218 of the piston rod, through passageway 222 of the piston head 220, and through porting 224 to the chamber 214 below the piston head. The pressurized gas forces the piston head upward. Upward movement of the piston head causes piston rod 216 to slide upwardly through the connector assembly 200 and into vent chamber 194. Movement of the piston head also pulls power rod 230 upwardly through a bore 232 defined in the lower end of the piston housing sub 210. Appropriate seals 234 and wipers 236 can be employed.

Movement of the power rod, axially, provides the necessary motion to set (or un-set) the settable tool positioned below the setting assembly. The setting force is supplied by the pre-charged fluid in the booster chamber. Carrying the setting force with a gas pre-charge means a large motor and battery arrangement, typical in many downhole force generators, is not required.

The entire assembly is compact, reducing the overall length of the tool assembly. This can be important in negotiating long, deviated or horizontal wellbores. Preferably, the length of the setting tool assembly is on the order of six feet for every eight inches of stroke.

Greater setting force can be provided by utilizing a force-multiplying piston having varying surface areas on either side of the piston head, as is known in the art. Further disclosure relating to force-multiplier piston assemblies can be found, for example, in U.S. Pat. Pub. No. 2006/0076144 to Shammai; U.S. Pat. Pub. No. 2006/0022013 to Gaudron; U.S. Pat. Pub. No. 2003/0075339 to Gano; U.S. Pat. No. 8,006,952 to Wygnanski; U.S. Pat. No. 6,966,370 to Cook; U.S. Pat. No. 7,000,705 to Buyers; each of which is incorporated herein by reference for all purposes.

A person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A setting tool for use in setting a settable downhole tool positionable in a subterranean wellbore, the setting tool comprising:

a tool housing positionable within the subterranean wellbore and comprising a port formed therein;

a booster assembly positioned in the tool housing and comprising a rechargeable energy source stored therein that is rechargeable through the port;

a piston assembly comprising a piston member mounted for movement in a piston chamber within the tool housing;

a release mechanism positioned in the tool housing and operable to release the energy stored in the booster assembly and move the piston member within the piston chamber; and a linkage assembly operable to transfer motion from the piston member to a settable downhole tool.

2. The tool of claim 1, wherein the booster assembly defines a pressurized chamber and wherein the energy source is a pressurized, inert gas positioned in the pressurized chamber.

3. The tool of claim 1, wherein the release mechanism is a selectively openable valve or selectively removable barrier.

4. The tool of claim 1, wherein the release mechanism includes a rupture disc or valve assembly.

5. The tool of claim 1, wherein the piston member, when the tool is positioned in the wellbore, is pressure-balanced.

6. The tool of claim 1, further comprising an actuator selectively operable to actuate the release mechanism.

7. The tool of claim 6, wherein the actuator comprises a pyrotechnic device operable to drive a movable actuator member to actuate the release mechanism.

8. The tool of claim 7, wherein the pyrotechnic device is triggered by an electrical charge from a battery carried on the tool.

9. The tool of claim 1, further comprising a flow restrictor positioned along the delivery system and operable to control the speed of movement of the piston member when the piston is driven in response to energy released from the booster assembly.

10. The tool of claim 1, wherein:

the booster assembly further comprises a booster assembly housing; and the piston assembly further comprises a piston housing.

11. The tool of claim 1, further comprising a control assembly positioned in the tool housing and operable to control the release mechanism, wherein the control assembly comprises a power source to provide power for the control assembly.

12. A method for setting a settable downhole tool positioned in a wellbore extending through a subterranean formation, the method comprising:

supplying a pressurized gas to a rechargeable pressure chamber within a setting tool through a port of the setting tool;

positioning the setting tool downhole in the wellbore;

operably connecting the setting tool to the settable downhole tool;

selectively releasing the pressurized gas from the pressure chamber to drive a piston member within a piston chamber; and setting the settable downhole tool in response to driving the piston member.

13. The method of claim 12, wherein releasing the pressurized gas further comprises opening a valve or rupturing a rupture disc.

14. The method of claim 12, further comprising exposing both sides of the piston member to hydrostatic pressure downhole.

15. The method of claim 12, further comprising initiating a pyrotechnic device utilizing an electric charge from a battery carried on the setting tool.

16. The method of claim 15, further comprising driving a piercing member through a rupture disc in response to the initiation of the pyrotechnic device.

17. The method of claim 12, further comprising controlling the rate of movement of the piston member during setting.

18. The method of claim 17, further comprising flowing the compressed gas through a flow restrictor.

19. An assembly for setting a downhole tool positionable in a wellbore extending through a subterranean formation, the assembly comprising:

a tool housing positionable within the subterranean formation and comprising a port formed therein;

a pressurized fluid chamber positioned in the tool housing and comprising a pre-charged pressurized fluid therein that is rechargeable through the port;

a piston assembly comprising a piston member slidably mounted in a piston chamber within the tool housing, the piston member dividing the piston chamber into two fluid chambers, one on either side of the piston member;

a fluid communication path positioned in the tool housing and extending between the pressurized fluid chamber and the piston chamber;

a selectively movable barrier positioned within the tool housing and along the fluid communication path, the barrier in a closed position blocking fluid flow from the pressurized chamber, and movable to an open position to allow fluid flow from the pressurized chamber to the piston chamber to move the piston member within the piston chamber; and a linkage operably attached to the piston member such that movement of the piston member results in movement of the linkage to set the downhole tool.

20. The assembly of claim 19, wherein the fluid communication path further comprises a fluid passageway extending through the piston member.

21. The assembly of claim 19, wherein the movable barrier further comprises a rupture disc or a valve member, and further comprising an actuator selectively operable to move the movable barrier to the open position.

22. The assembly of claim 19, further comprising a flow restrictor positioned along the fluid communication path to control the speed of movement of the piston member.

* * * * *